US011590042B2

(12) United States Patent
Ozbun

(10) Patent No.: US 11,590,042 B2
(45) Date of Patent: Feb. 28, 2023

(54) LIGHTWEIGHT DOME-SHAPED CASKET LID AND METHOD OF MANUFACTURE

(71) Applicant: Matthews International Corporation, Pittsburgh, PA (US)

(72) Inventor: Leland D. Ozbun, Lynn, IN (US)

(73) Assignee: Matthews International Corporation, Pittsburgh, PA (US)

( * ) Notice: Subject to any disclaimer, the term of this patent is extended or adjusted under 35 U.S.C. 154(b) by 0 days.

(21) Appl. No.: 17/101,977

(22) Filed: Nov. 23, 2020

(65) Prior Publication Data

US 2021/0282998 A1 Sep. 16, 2021

Related U.S. Application Data

(63) Continuation of application No. 16/057,642, filed on Aug. 7, 2018, now Pat. No. 10,842,702, which is a continuation of application No. 15/463,767, filed on Mar. 20, 2017, now Pat. No. 10,064,777, which is a continuation of application No. 14/845,623, filed on Sep. 4, 2015, now Pat. No. 9,629,773, which is a continuation of application No. 13/578,074, filed as application No. PCT/US2011/025602 on Feb. 21, 2011, now Pat. No. 9,125,781.

(Continued)

(51) Int. Cl.

| | |
|---|---|
| ***A61G 17/007*** | (2006.01) |
| ***A61G 17/02*** | (2006.01) |
| ***B27N 5/00*** | (2006.01) |

(52) U.S. Cl.

CPC ..... *A61G 17/0073* (2013.01); *A61G 17/02* (2013.01); *B27N 5/00* (2013.01); *Y10T 156/1002* (2015.01)

(58) Field of Classification Search

CPC .... A61G 17/02; A61G 17/0073; A61G 17/00; A61G 17/007; A61G 17/034; A61G 17/042; B27N 5/00; Y10T 156/1002; B65D 5/64; B65D 9/32

USPC ..... 27/2, 4, 14, 16, 19; 156/196; 229/125.01; 220/252; 217/56, 57; 264/101

See application file for complete search history.

(56) References Cited

U.S. PATENT DOCUMENTS 2,338,035 A 12/1943 Lawrence
2,974,390 A * 3/1961 Nelson ..... A61G 17/0136 27/7

(Continued)

FOREIGN PATENT DOCUMENTS

WO 2011/103534 A1 8/2011

OTHER PUBLICATIONS

International Search Report and Written Opinion dated Nov. 4, 2011 for PCT/US2011/025602.

*Primary Examiner* — William L Miller
(74) *Attorney, Agent, or Firm* — DLA Piper LLP

(57) ABSTRACT

A novel technique for the fabrication of a casket dome lid from, for example, Smooth-One-Side ("S1S") hardboard is disclosed. The invention is also directed to the fabrication of a casket lid which has a domed configuration both in the lateral and longitudinal directions of the lid. The method comprises the steps of providing a lid blank having a first end, second end, and a central region; providing a pair of diagonal voids oriented at corners of the first end of said blank and extending inward toward the central region; placing the lid blank in a vacuum fixture; and flexing the lid blank into a domed configuration via the vacuum fixture, such that the blank is domed in both a longitudinal and a transverse direction.

11 Claims, 11 Drawing Sheets

Related U.S. Application Data

(60) Provisional application No. 61/306,003, filed on Feb. 19, 2010.

(56) References Cited

U.S. PATENT DOCUMENTS

| | | | | |
|---|---|---|---|---|
| 4,730,370 | A | 3/1988 | Elder | |
| 4,773,134 | A | 9/1988 | Kay | |
| 4,944,076 | A | 7/1990 | Kay et al. | |
| 5,454,141 | A | 10/1995 | Ozbun et al. | |
| 5,862,847 | A | 1/1999 | Jenkins | |
| 5,974,640 | A | 11/1999 | Vosahlik et al. | |
| 6,094,789 | A | 8/2000 | Hankel et al. | |
| 6,243,931 | B1 | 6/2001 | Linville et al. | |
| 6,503,429 | B1 | 1/2003 | Linville et al. | |
| 6,849,141 | B2 | 2/2005 | Buchler et al. | |
| 7,247,264 | B2 | 7/2007 | Buchler et al. | |
| 7,380,316 | B1 | 6/2008 | Sauder et al. | |
| 7,594,306 | B2 | 9/2009 | Beaulne et al. | |
| 9,125,781 | B2 | 9/2015 | Ozbun | |
| 9,629,773 | B2 | 4/2017 | Ozbun | |
| 10,064,777 | B2 | 9/2018 | Ozbun | |
| 11,141,339 | B1 * | 10/2021 | Henderson | A61G 17/0106 |
| 2002/0023325 | A1 | 2/2002 | Fant et al. | |
| 2005/0125974 | A1 | 6/2005 | Ozbun | |
| 2007/0050959 | A1 | 3/2007 | Biterman | |
| 2013/0167336 | A1 | 7/2013 | Boots et al. | |
| 2015/0074962 | A1 | 3/2015 | Ehsani | |
| 2015/0121670 | A1 | 5/2015 | Cox et al. | |
| 2019/0110942 | A1 | 4/2019 | Ozbun | |

* cited by examiner

LIGHTWEIGHT DOME-SHAPED CASKET LID AND METHOD OF MANUFACTURE

CROSS REFERENCE TO RELATED APPLICATIONS

This application is a continuation of U.S. application Ser. No. 15/463,767, now U.S. Pat. No. 10,064,777, filed Mar. 20, 2017, which is a continuation of U.S. application Ser. No. 14/845,623, now U.S. Pat. No. 9,629,773, filed Sep. 4, 2015, which is a continuation of U.S. application Ser. No. 13/578,074, now U.S. Pat. No. 9,125,781, filed Aug. 9, 2012, which is a national phase of PCT/US2011/025602 filed Feb. 21, 2011 and claims priority to U.S. Provisional Patent Application No. 61/306,003, filed Feb. 19, 2010, all of which are hereby incorporated by reference in their entirety as if fully set forth herein.

FIELD OF INVENTION

This invention relates generally to caskets and, more particularly, to a method of making a one-piece unity lid for caskets with support members and, even more particularly, to light-weight cremation caskets produced by, but not limited to, a novel vacuum fixture forming method.

BACKGROUND

Lower end caskets have been fabricated out of materials, such as particle board, medium density fiberboard ("MDF"), and corrugation. An outer skin, such as cloth, wood veneer, and paper veneer is then adhered to the outer surface of the casket. When corrugation is used, the top, or lid, of the casket has been limited to a flat top, or a raised flat top. Dome-shaped tops are generally constructed of medium density fiberboard covered with wood veneer or paper veneer. In order to fabricate such a top, several different pieces must be assembled and secured together with adhesive and fasteners. This process is time consuming and complicated and can drastically increase the cost to prepare a casket lid. A need exists for a dome lid with a reduced number of component parts. There also exists a need in the art for a process of producing dome lids, wherein assembly time and cost associated with fabricating the lid are reduced.

SUMMARY

The present invention provides a novel technique for the unitary fabrication of a casket dome lid from Smooth-One-Side ("S1S") hardboard. The invention is also directed to the fabrication of a casket lid which has a domed configuration both in the lateral and longitudinal directions of the lid.

The invention is also directed to a unitary dome casket lid that provides a lid structure of substantial strength and rigidity having a flawless outer surface capable of accepting wood veneer, paper veneer, or cloth. The dome may be attached to side and end rim or rail configurations extending laterally and longitudinally along the lid. The lid may be fabricated from S1S hardboard.

A method of manufacturing a one-piece unity lid for caskets may include the steps of providing a lid blank having a first end, second end, and a central region; providing a pair of diagonal voids oriented at corners of the first end of said blank and extending inward toward the central region, each void having routed edges at a periphery of the voids; placing the lid blank into a vacuum fixture; and flexing the lid blank into a domed configuration via the vacuum fixture, such that routed edges of the voids meet providing the blank in a domed configuration in both a longitudinal and a transverse direction. A header bridge may also be attached to the central region of the lid blank. A support bridge may be attached to the lid blank between the first end of the lid blank and the header bridge. The step of providing a lid blank may include providing a first lid blank half, and the method may further include removing the first lid blank half from the vacuum fixture; providing a second lid blank half having a first end, second end, and a central region; providing a pair of diagonal voids oriented at corners of the first end of said second lid blank half and extending inward toward the central region, each void having routed edges at a periphery of the voids; placing the second lid blank half into the vacuum fixture; flexing the second lid blank half into a domed configuration via the vacuum fixture, such that routed edges of the voids meet providing the blank in a domed configuration in both a longitudinal and a transverse direction; and pairing the first lid blank half with the second lid blank half with the second end of the first lid blank half facing the second end of the second lid blank half to provide a completed unity lid. A header bridge may also be attached to each of the second ends of the lid blank halves. After the step of flexing, the method may include filling the voids with an adhesive. The step of providing voids includes removing material from the blank by a Computer Numerically Controlled Router. Additionally, trim edges may be provided around a periphery of the blank with a plurality of frame members being attached to the blank at the trim edges. A support laminate may also be provided, wherein the support laminate is shaped, such that the support laminate includes a plurality of tabs, and the support laminate is attached to the first end of the blank with the tabs being secured to the frame members. Rim members may also be attached along an edge of the first end and along sides of the central region of the lid blank.

In an alternative embodiment, a pair of diagonal voids may also be provided at the second end of the blank with the voids being oriented at corners of the second end of said blank and extending inward toward the central region, each void having routed edges at a periphery of the voids, wherein the lid blank is flexed into a domed configuration via the vacuum fixture, such that routed edges of the voids meet providing the blank in a domed configuration in both a longitudinal and a transverse direction to provide a single lid blank unity lid. Again, the header bridge may be attached to the central region of the domed lid blank. After the step of flexing, the voids may be filled with an adhesive. Also, like the previous embodiment, trim edges may be provided around a periphery of the blank, wherein a plurality of frame members may be attached to the blank at the trim edges. In this embodiment, the method may also include the steps of providing a support laminate; shaping the support laminate, such that the support laminate comprises a plurality of tabs; attaching the support laminate to the first end of the blank; and securing the tabs to the frame members.

The one-piece unity lid for a casket may include a domed lid blank comprising a plurality of trim edges around a periphery of the blank and having a first end, a second end, and a central region, the blank being domed in both a longitudinal direction and a transverse direction; a plurality of frame members attached to the domed lid blank trim edges; and a support laminate comprising a plurality of tabs, the support laminate being fixed to the blank, wherein the tabs are secured to the frame members. It may further include a header bridge attached to the central region of the domed lid blank. A support bridge can also be attached to the lid blank between the first end of the lid blank and the header bridge. The domed lid blank may be a first domed lid blank half including a header bridge attached to the second end of the first domed lid blank half. A second domed lid blank half may be included having a second plurality trim of edges around a periphery of the second lid blank half and having a first end, a second end, and a central region, the second domed lid blank half being domed in both a longitudinal direction and a transverse direction; a second plurality of frame members attached to the domed lid blank trim edges; a second support laminate comprising a plurality of tabs, the second support laminate being fixed to the blank, wherein the tabs are secured to the frame members; and a second header bridge attached to the second end of the second domed lid blank half; wherein the first domed lid blank half and the second domed lid blank half are adapted to be attached to a casket shell with the second end of the first domed lid blank half facing the second end of the second domed lid blank half. Rim members may also be attached to the periphery of the lid blank.

DETAILED DESCRIPTION

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices and methods illustrated in the accompanying drawing figures and described herein are simply exemplary and should not be considered as limiting.

In considering various figures of the drawings it should be kept in mind that the dome lid of the present invention is suitable for use with a wide variety of casket shells. In a typical case, it is contemplated that the casket dome lid and process of producing the same according to the present invention will comprise corrugated fiberboard, however, any other suitable material is also contemplated.

Figure 1:
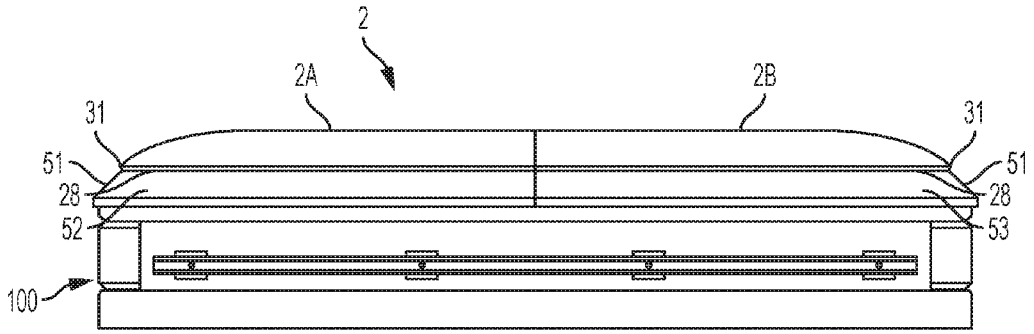
FIG. 1 is a side elevation view of a domed lid according to the present invention and applied to a casket shell.

The dome lid 2 of the present invention may be used with a casket shell 100, as shown in FIG. 1, which may comprise, for example, corrugated fiberboard sheet material.

Figure 2:
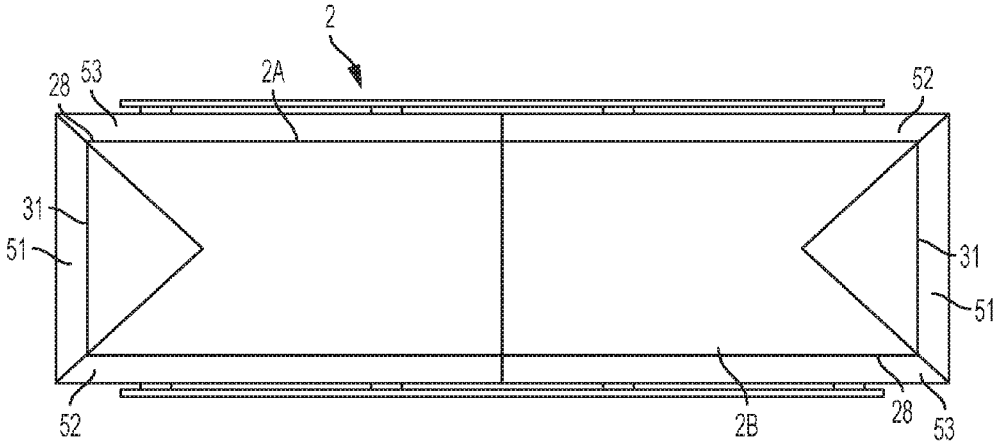
FIG. 2 is a top view of the lid of the casket shown in FIG. 1.
Figure 3:
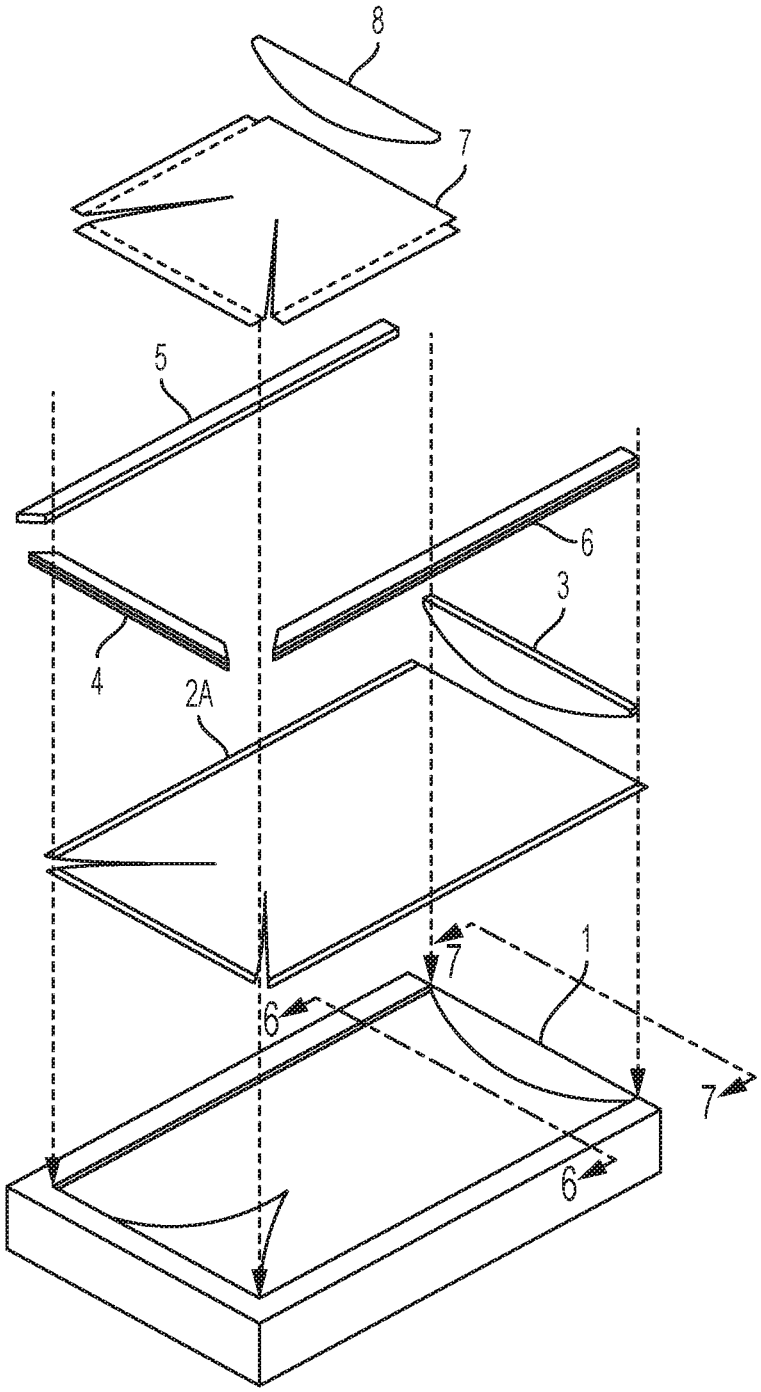
FIG. 3 is a perspective view of a vacuum fixture and sequence of assembly of the lid according to the invention.

From FIGS. 1-3, it can be seen that the unity of two halves, 2A, 2B will result in one complete unity dome 2. The dome lid comprises a domed configuration along both longitudinal and transverse directions, along the length of the lid and casket. The central portion of the lid is transversely domed and the end portions are longitudinally domed. Preferably, the central and end domed portions of the lid are surrounded by small trim edges 28, 31. The trim edges 28, 31 extend all the way around the dome.

Figure 4:
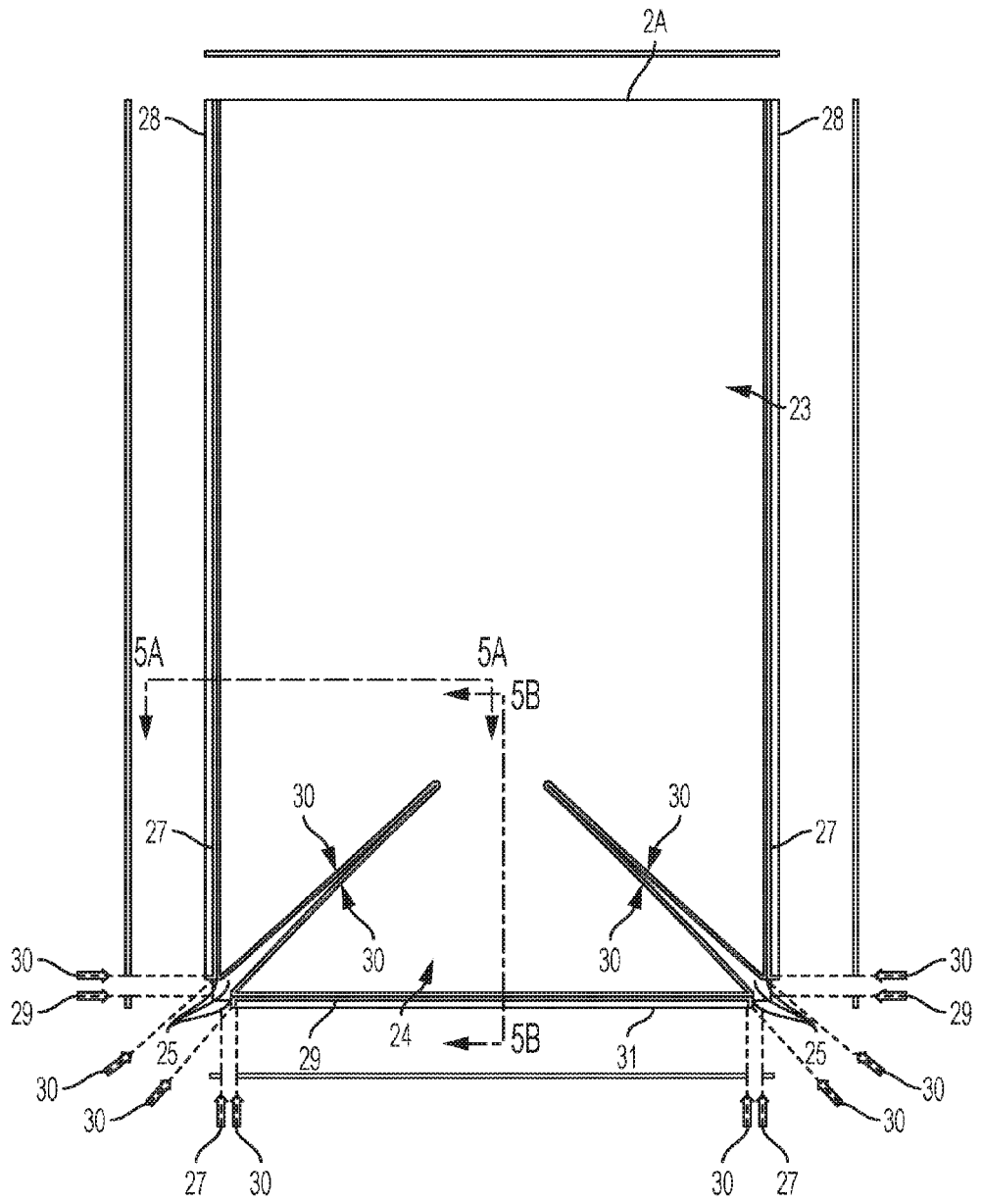
FIG. 4 is a plan view of a cut blank prepared for formation of a dome top according to the present invention.
Figure 8:
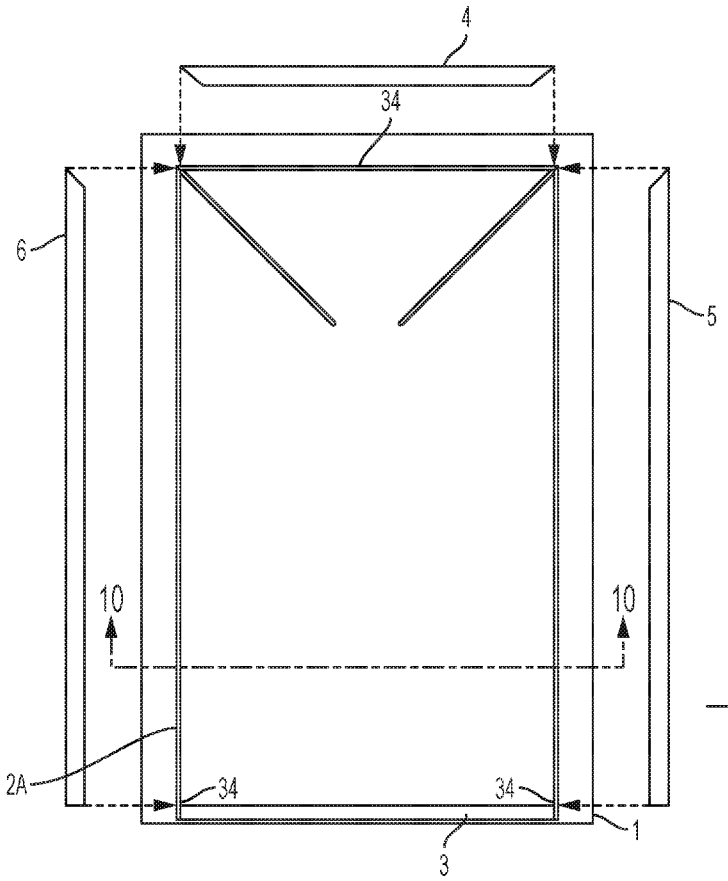
FIG. 8 is a plan view of the placement of adhesive and frame members onto the domed fiberboard.
Figure 9:
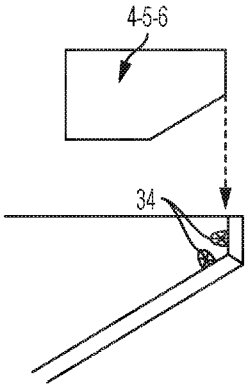
FIG. 9 is an exploded end profile view of the invention showing the placement of frame members and corresponding adhesive.
Figure 10:
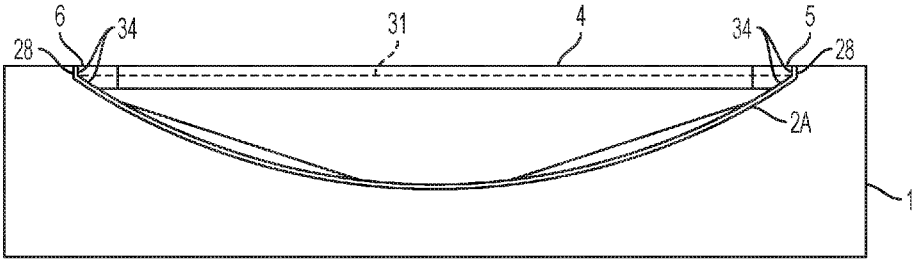
FIG. 10 is a cross-sectional view taken as indicated by the section lines 10-10 of FIG. 8.

The following description will be made with reference to one unity dome half 2A with it being contemplated that the second half 2B will be constructed in an identical manner. In the fabrication of a unity dome lid, according to this invention, a blank 2A is cut from S1S hardboard, for example, as shown in FIGS. 1-4, with the smooth side of the S1S hardboard being the outer surface. The present invention also contemplates a number of other materials, for example luan, cellulose fiberboard, and Smooth-Two-Side (S2S) hardboard. In the fabrication of a dome lid, according to a preferred embodiment of the invention, the blank 2A is cut from the S1S hardboard sheet material of overall general dimensions corresponding to a desired length and width of the unity dome lid being formed. The blank 2A may be cut from a hardboard material of any suitable thickness, for example, 0.125 inch thick material. As shown in FIG. 4, the blank 2A has a central portion 23 corresponding to the principal portion of the central region of the dome lid. The blank 2A also includes an end portion 24 corresponding to the end of the dome lid. These various areas are defined in part by the cutting of generally diagonal voids 25 having routed edges 30 along the periphery of the voids 25, as shown in FIG. 4. The central portion 23 may also comprise cutouts 27. The voids 25 facilitate and provide the transversely domed configuration of the dome lid by allowing the blank 2A to be flexed transversely and longitudinally. As shown in FIG. 4, the cutouts 27 also aid in defining the trim edges 28, as explained below, and also provide an area for adhesive for bonding the frame members 5, 6, as illustrated in FIGS. 8-10.

Still referring to FIG. 4, the end portion 24 of the blank 2A is also provided with cutouts 29. Cutout 29 similarly aids in defining the trim edge 31 on the end portion 24 of the blank 2A of the dome lid, as explained below, and also provides an area for adhesive for bonding a frame member 4, as shown in FIGS. 8-10.

As indicated above, in addition to the transversely domed configuration of the central portion 23 of the lid, the end portion 24 is also curved to a domed configuration. The voids 25 are configured and positioned so as to accommodate the longitudinal domed configuration. That is, the voids 25 are provided so that the blank 2A can be properly placed in a vacuum fixture 1 and then flexed into the domed configuration with a specific radius. Voids 25 permit the two routed edges 30 to come together joining the edge portions of the central region 23 and longitudinal portion 24. The central region 23 and the end portion 24 are flexed to a domed configuration and placed in an appropriate vacuum fixture 1, as shown in FIGS. 3-8. The dome may then be further assembled. When the routed edges 30 are flexed to join the central region 23 and the end portion 24 to form the domed configuration, any residual gaps left from voids 25 will be filled with an appropriate adhesive at a later time in construction.

The above mentioned cutouts and/or routed edges 27, 29, 30 in FIG. 4 may be provided by a CNC (Computer Numerically Controlled) Router using a 90 degree V-groove router bit, programmed to different depths, to remove different amounts of material to allow for the flexing of the blank 2A resulting in the dome top configuration. The blank 2A is set in a specific location on the router table. The router head is programmed for a cutting path and depth on the blank 2A corresponding to cutouts and/or routed edges 27, 29, 30.

Figure 5:
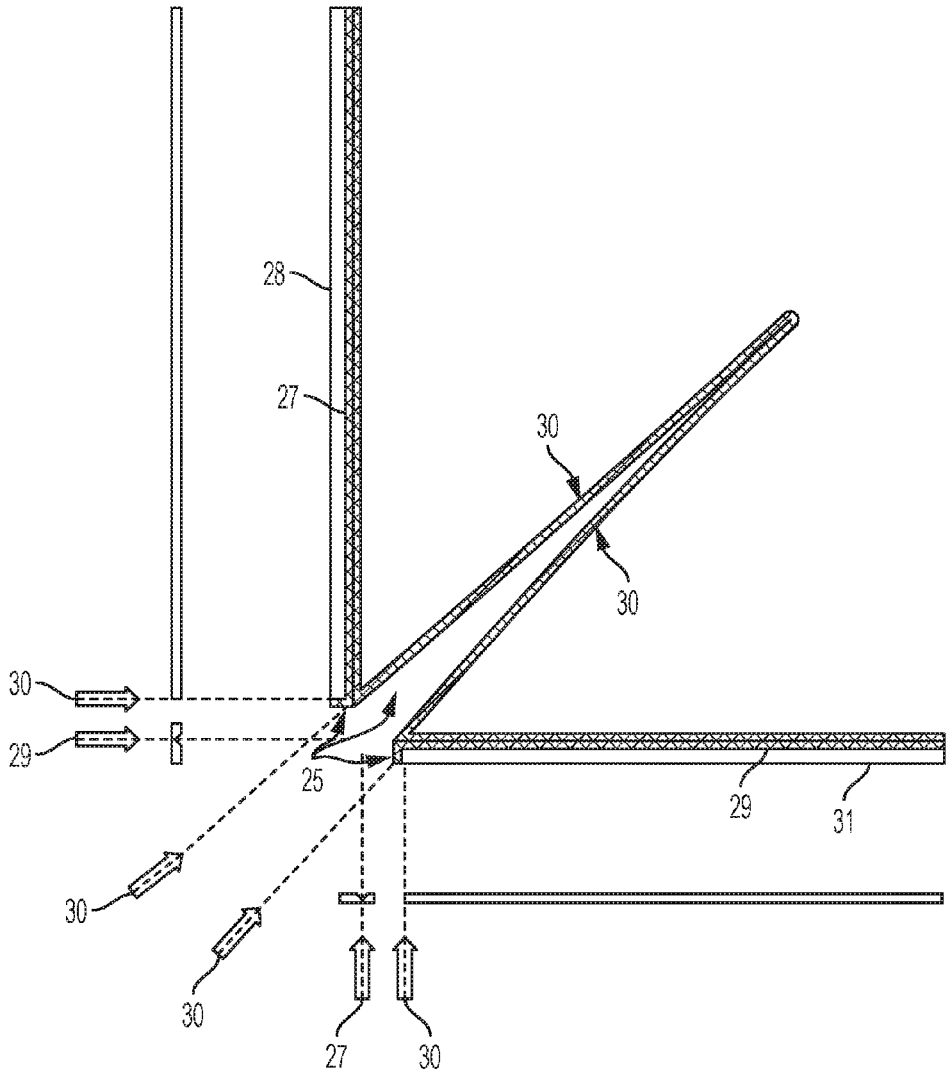
FIG. 5 is an enlarged fragmentary view taken as indicated by the section lines 5A-5A, 5B-5B of FIG. 4.

Referring to FIG. 4 and the fragmentary sectional view of FIG. 5 taken as indicated by the section lines 5A-5A, 5B-5B, the V-groove router bit following the path of cutouts 27, 29 may remove approximately up to three quarters of the hardboard material in those paths, for example, depending on how the router was programmed. It is also clearly indicated that the hardboard material following the router bit path indicated by routed edges 30 is completely removed, leaving the open diagonal voids 25. FIG. 4 shows that after material is removed from the blank 2A leaving a V-groove forming cutouts 27, 29, the material between cutouts 27, 29 and the edges of the blank 2A define trim edges 28, 31, respectively.

Figure 6:
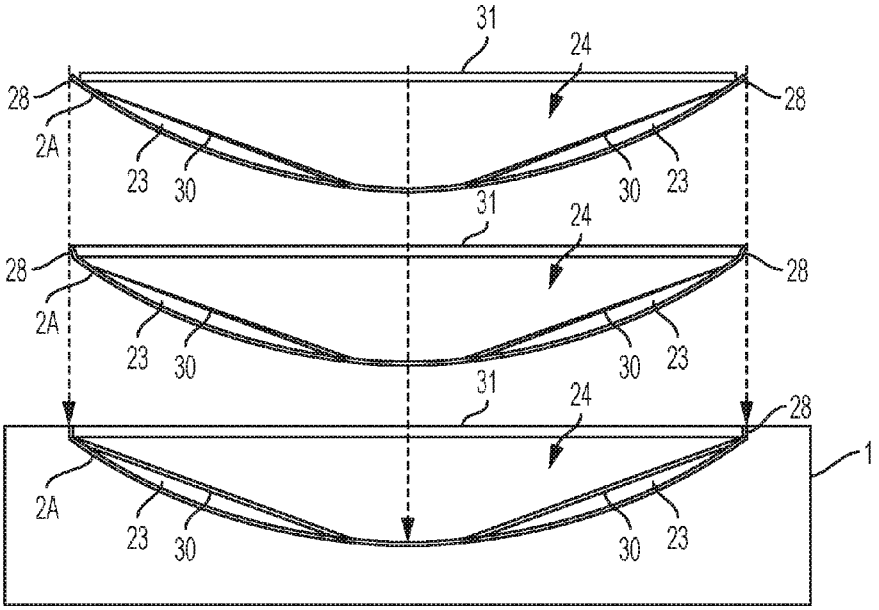
FIG. 6 is a plan view of the side trim and end trim with the domed portions being formed as the hardboard is placed into the vacuum fixture.

After completing the above CNC router operation, the hardboard blank is placed in an appropriate vacuum fixture 1, as shown in FIG. 3. The sequence of the order of assembly of the present invention is represented by the perspective view of FIG. 3. FIG. 6 is a cross-sectional view taken at section lines 6-6 of FIG. 3, which shows the transversely and longitudinally domed portions of the lid 23, 24 and the trim edges 28, 31 being formed as the hardboard blank 2A is being placed in the appropriate vacuum fixture 1, shown in FIGS. 3, 6, 7, 8 and 10. As shown, the trim edges 28, 31 are folded upward along the cutouts 27, 29, thereby providing for an exact fit into the vacuum fixture 1. The vacuum fixture 1 essentially comprises a female version of a finished dome top. The blank 2A is placed into the vacuum fixture 1. When a vacuum pump in the vacuum fixture 1 is turned on, the blank 2A is flexed into the domed-shape via the vacuum force of the vacuum fixture, at which point further construction of the dome can go forward by the addition of other components.

Figure 7A:
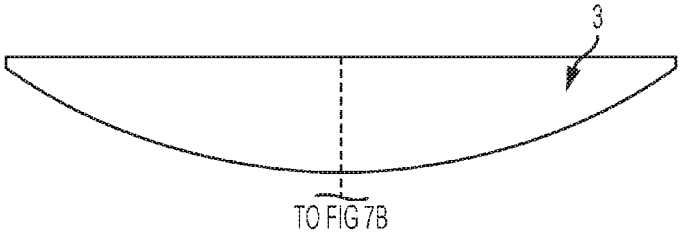
FIG. 7A is a plan view of the header bridge.
Figure 7B:
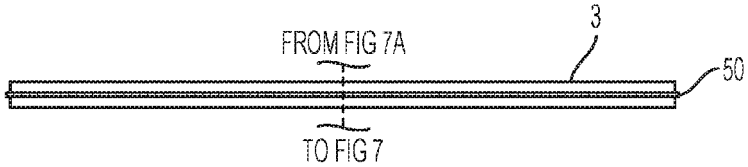
FIG. 7B is a side end view of the placement of adhesive onto the header bridge.
Figure 7:
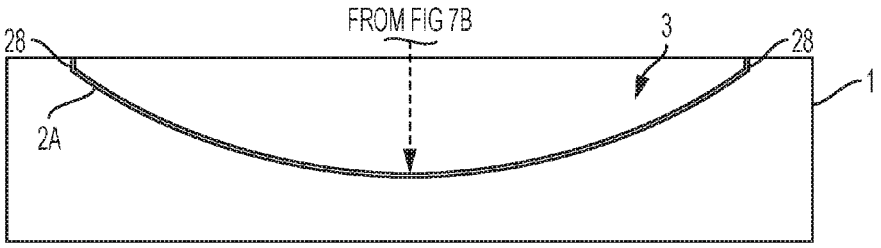
FIG. 7 is an end view of the vacuum fixture with a header bridge in place.

The next sequence of assembly is attaching a header bridge 3, as illustrated in FIG. 3, to the blank 2A. The header bridge 3 in this case is MDF but could be any material structurally strong enough to prevent the dome from flexing outward. FIG. 7 is an end view taken as indicated by the section lines 7-7 of FIG. 3. Referring to FIGS. 7A and 7B, the header bridge 3 is an exact mirrored image of the arched hardboard blank 2A and trim edge 28, as positioned in the vacuum fixture 1. Referring to FIG. 7B, a bead of an appropriate amount of adhesive 50 is placed on the arched portion of the header bridge 3 and is mated with the domed hardboard in at the end of the vacuum fixture 1 opposite end portion 24.

Next, the frame members 4, 5, and 6, shown in FIG. 3, are attached. FIG. 8 is a plan view of the hardboard blank 2A and header bridge 3 in place in the appropriate vacuum fixture 1. FIG. 9 is an end view of the profile of the frame members 4, 5 and 6 and the location of the beads of adhesive 34 which secures the frame members to the periphery of the hardboard dome. The location of beads 34 is also illustrated in FIG. 8.

FIG. 10 is a cross-section view as taken at section lines 10-10 of FIG. 8. FIG. 10 indicates that the frame members 4, 5, and 6 are secured to a portion of the hardboard arched dome formed from blank 2A and to the trim edges 28, 31. The frame members 4, 5, and 6 in this particular case are MDF but may comprise any material with sufficient strength to keep the dome from flexing.

Figure 11:
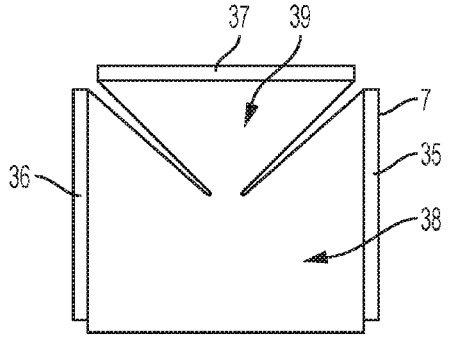
FIG. 11 is a plan view of a fiberboard support laminate.
Figure 12:
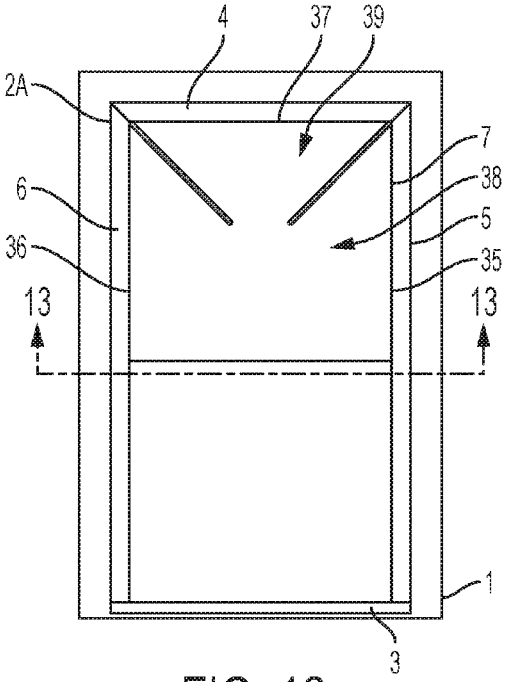
FIG. 12 is a plan view of the support laminate installed into the underside of the dome.
Figure 13:
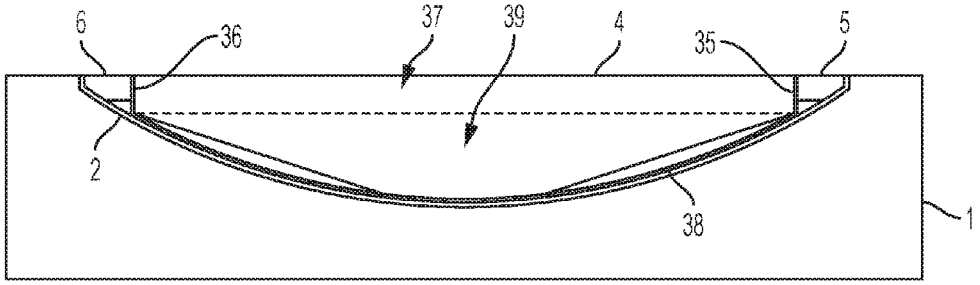
FIG. 13 is a cross-sectional view of the support laminate as indicated by section lines 13-13 of FIG. 12.

Next, a support laminate 7, as shown in FIG. 3, may be fixed to the blank 2A. The support laminate 7 may, for example, comprise solid fiberboard material, 0.062 inches in thickness, however, any suitable material and thickness is contemplated. In this particular embodiment, one side of the support laminate 7 is covered with an adhesive and placed against the hardboard 2A at the end opposite from the header bridge 3. Referring to FIG. 11, the support laminate 7 comprises three tabs 35, 36, 37 which are bent upward to, for example, approximately 90 degrees, thereby allowing the support piece to be secured to the frame members 4, 5, 6 with an appropriate adhesive, or fasteners, or both. FIG. 12 illustrates the hardboard blank 2A in conjunction with the attached header bridge 3, frame members 4, 5, 6 and support laminate 7 in the appropriate vacuum fixture 1. FIG. 13 is a cross-sectional view taken at section lines 13-13 of FIG. 12. In FIG. 13, it can be seen that the tabs 35, 36, 37 are attached to the frame members 4, 5, 6. It can also be seen that the transverse 38 and longitudinal 39 areas of the support laminate 7 of FIG. 11 are secured to the transverse 38 and longitudinal 39 areas of FIG. 4 with an appropriate adhesive. The unity of the blank 2A and support laminate 7 prevents the dome portions of the top from flexing outward, which is the purpose of the support laminate 7. The support laminate 7 may consist of a fiberboard material, 0.062 inches in thickness, for example, however, it could be any material and thickness that would prevent the dome top from flexing both transversely and longitudinally.

Figure 14:
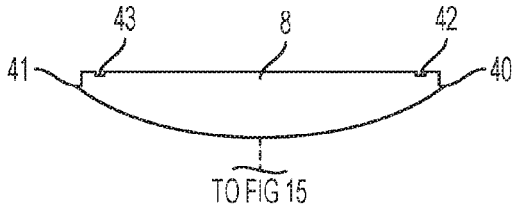
FIG. 14 is a plan view of a fiberboard support bridge.
Figure 15:
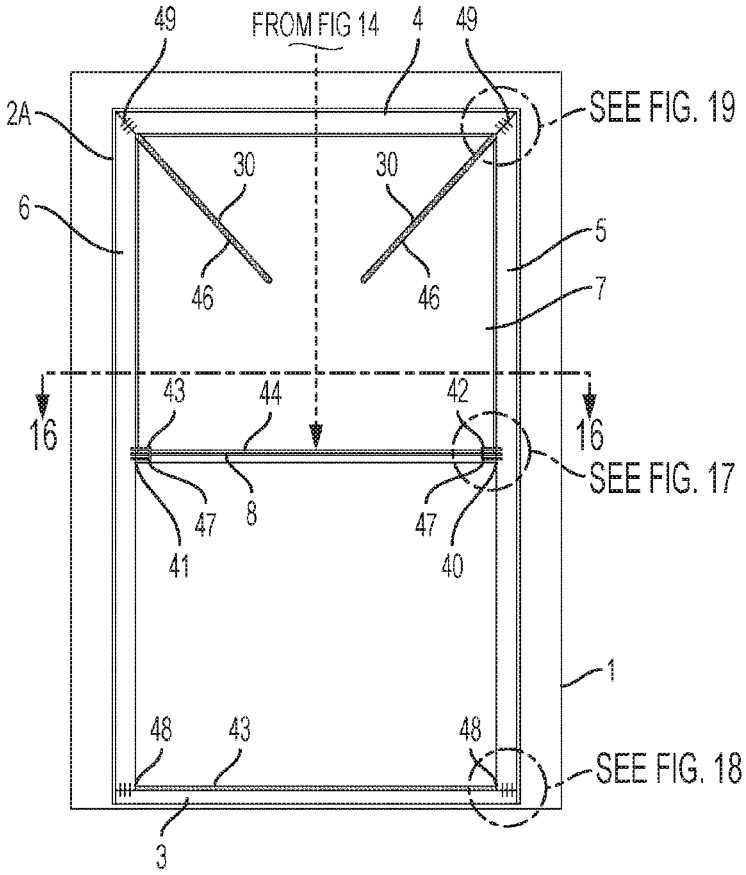
FIG. 15 is a plan view of the support bridge installed into the underside of the dome.
Figure 16:
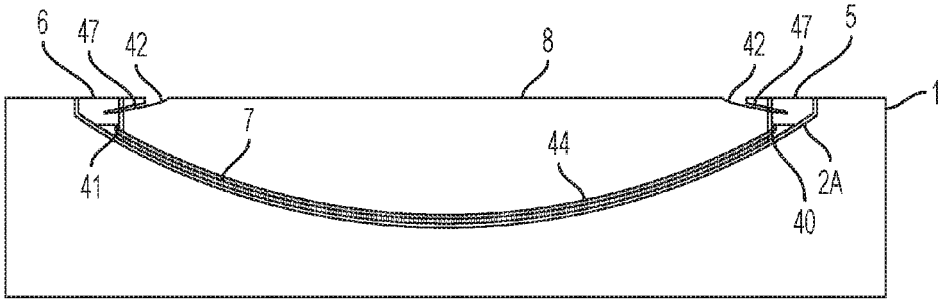
FIG. 16 is a cross-sectional view of the support bridge as indicated by the section lines 16-16 of FIG. 15.
Figure 17:
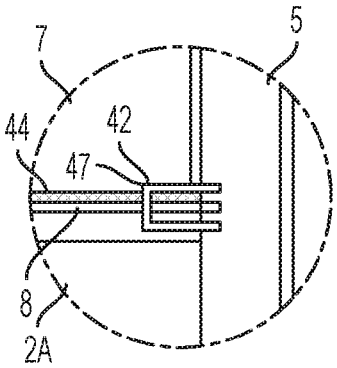
FIG. 17 is an enlarged view of encircled area B of FIG. 15.
Figure 18:
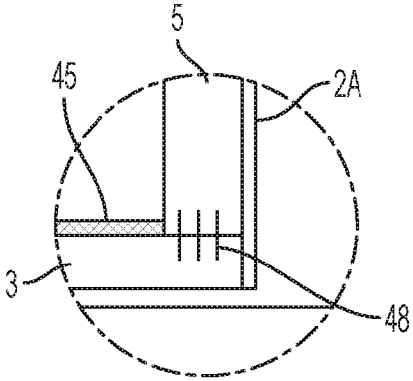
FIG. 18 is an enlarged view of encircled area C of FIG. 15.

Referring to FIG. 3, a support bridge 8 may be added. The support bridge 8 may also comprise fiberboard material which is 0.090 inches in thickness, but could be of any suitable material and thickness. FIG. 14 is a plan view of the support bridge 8 which resembles the profile of the header bridge 3 explained above. The support bridge 8, however, also comprises notches 40, 41 at opposite ends which extend under the frame members 5, 6 when attached to the rest of the dome assembly. This can be seen in FIG. 16, which is a cross-sectional view taken at section lines 16-16 of FIG. 15, which shows the hardboard blank 2A, the header bridge 3, the frame members 4, 5, 6, the support laminate 7, and the support bridge 8 in plan view. Fasteners 47 protrude from the notches 42, 43 into the frame members 5, 6. FIG. 17 is an enlarged view of the encircled area of the support bridge 8 showing the support bridge 8 adjoined to the frame member 5 via fastener 47. A bead of appropriate adhesive 44 is placed along the arched perimeter of the support bridge 8 and the support laminate 7 from frame member 5 to frame member 6. FIG. 18 is an enlarged view of the encircled area of fasteners 48 for attaching the frame members 5, 6 to the header bridge 3. FIG. 18 also shows that there is a bead of appropriate adhesive 45 placed along the arched edge of the header bridge 3 and the hardboard blank 2A extending from frame member 5 to frame member 6.

Figure 19:
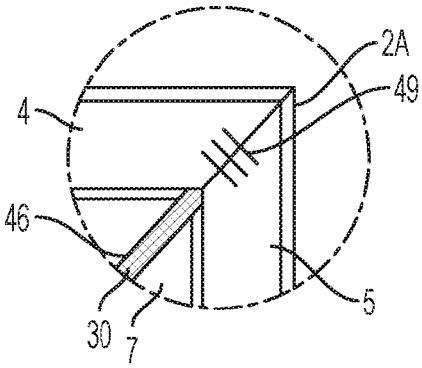
FIG. 19 is an enlarged view of encircled area A of FIG. 15.

FIG. 19 is an enlarged view of the encircled area of fastener 49 for attaching the frame members 5, 6 to frame member 4. FIG. 19 also shows a bead of appropriate adhesive 46 placed in the voids 30, mentioned in an above paragraph. The fasteners 47, 48, 49, as depicted in FIGS. 14-19, may take the form of staples, for example, that, when stapled by an air operated staple gun, protrude into members 5, 6.

Figure 20:
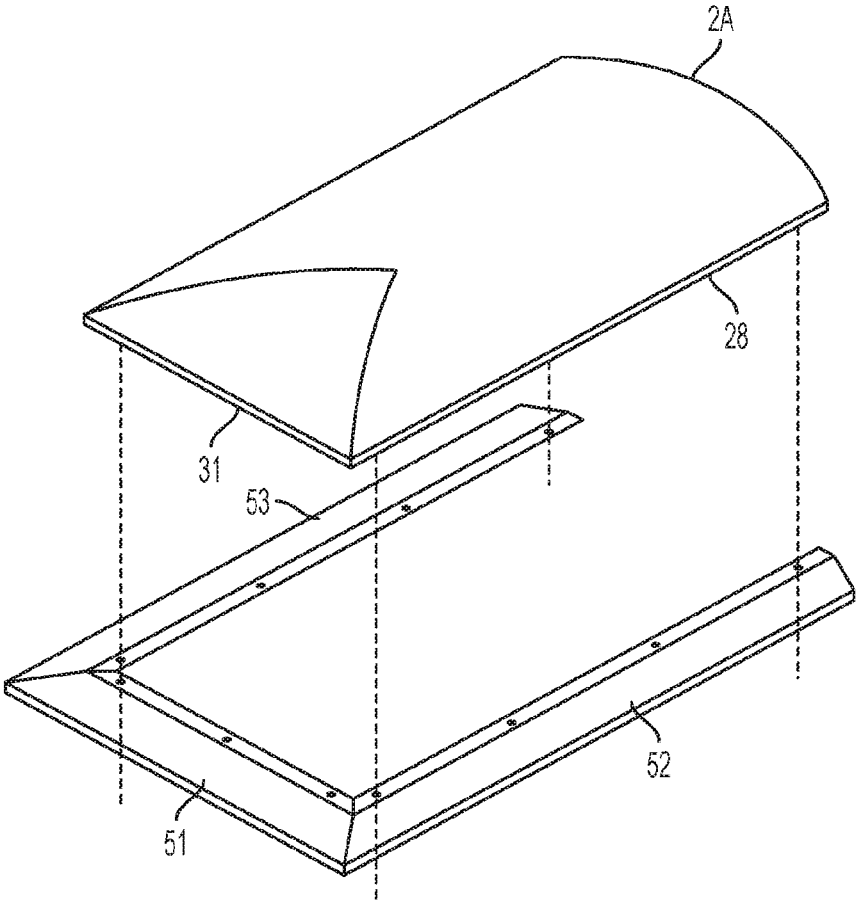
FIG. 20 is a perspective view of a manufactured dome being attached to unity side and end rims or rails.
Figure 21:
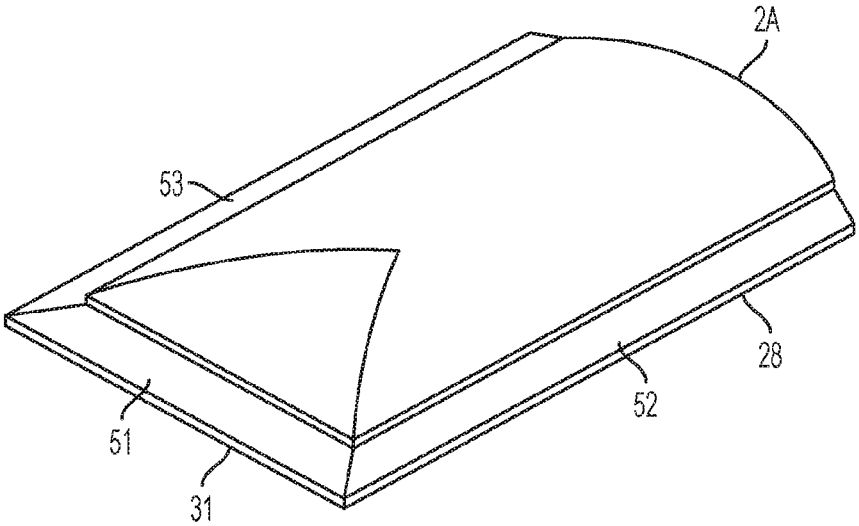
FIG. 21 is a perspective view of a completed unity dome top.

FIG. 20 is a perspective view of a finished unity dome lid half 2A removed from the vacuum fixture 1, lightly sanded in an appropriate area and covered with the appropriate adhesive and laminate. This laminate could be paper veneer, wood veneer, cloth veneer, etc. The finished unity dome lid half 2A is then attached to the appropriate rim members 51, 52, 53. The rim members 51, 52, 53, illustrated in FIGS. 20-21, could be of any desired profile but the details are not illustrated. Finally, the finished unity dome lid half 2A is then paired with an identical dome lid half 2B, as shown in FIG. 1, to form a complete unity dome lid 2, which is then attached to casket shell 100.

Figure 22:
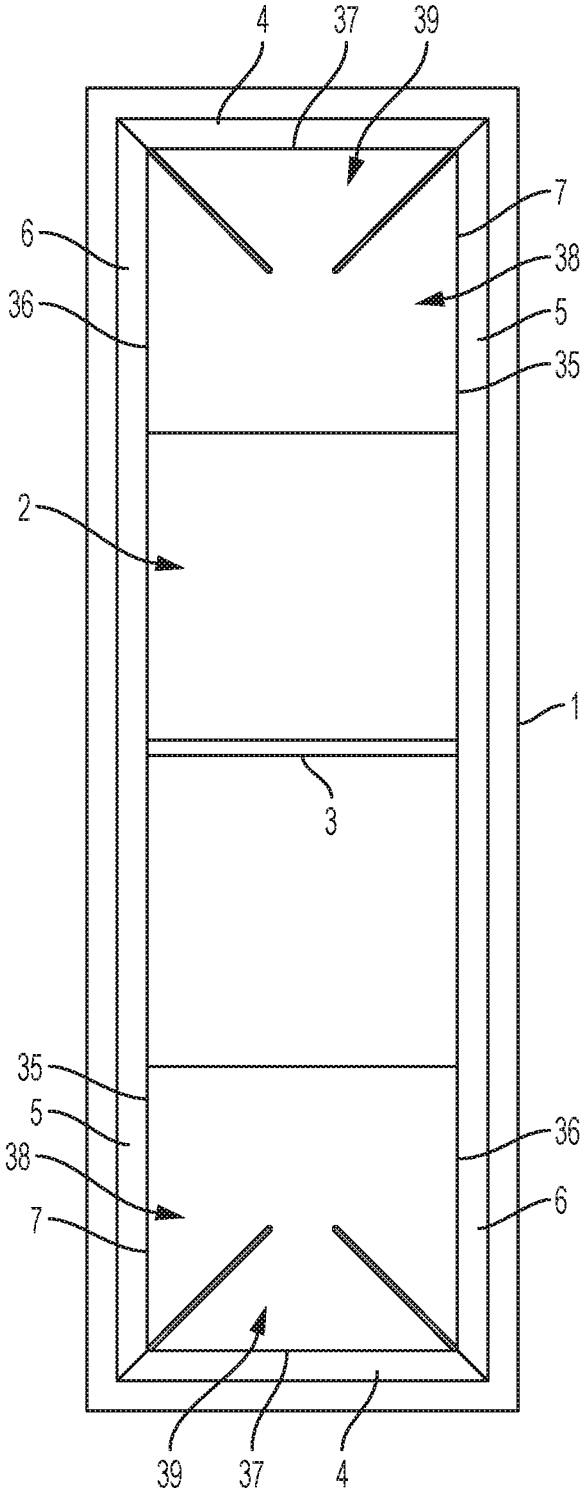
FIG. 22 is a plan view of a unity being constructed out of single hardboard blank in a vacuum fixture.

In an alternative embodiment of the invention, referring to FIG. 22, the finished unity dome lid, may be manufactured from a single hardboard blank 2, performing the operations for both halves of lid 2 at the same time, as opposed to manufacturing the two halves 2A, 2B separately and subsequently joining them together. This may require the use of a different suitable vacuum fixture 1 capable of receiving the single hardboard blank, as shown.

While embodiments of a method of making a one-piece unity lid for caskets with support members were described in the foregoing detailed description, those skilled in the art may make modifications and alterations to these embodiments without departing from the scope and spirit of the invention. Accordingly, the foregoing description is intended to be illustrative rather than restrictive.

What is claimed is:

1. A lid for a casket comprising:

a domed lid blank, having a first end, a second end, and a central region, comprising a pair of diagonal voids oriented at corners of the first end and extending inward toward the central region and a plurality of trim edges around a periphery of the domed lid blank;

a plurality of frame members attached to the trim edges of the domed lid blank;

a support laminate comprising a plurality of tabs, the support laminate being fixed to the domed lid blank, wherein the tabs are secured to the frame members; and a plurality of rim members attached to the periphery of the domed lid blank, wherein the plurality of rim members are attached along an edge of the first end and along sides of the central region of the domed lid blank.

2. The lid for a casket according to claim 1, further comprising a header bridge attached to the central region of the domed lid blank.

3. The lid for a casket according to claim 1, further comprising a support bridge attached to the lid blank between the first end of the lid blank and a header bridge.

4. The lid for a casket according to claim 3, wherein the support bridge comprises a plurality of notches that extend under the plurality of frame members, wherein a fastener protrudes from each notch on the support bridge into a longitudinal frame member of the plurality of frame members.

5. The lid for a casket according to claim 1, wherein the domed lid blank comprises a first domed lid blank half comprising a header bridge attached to the second end of the first domed lid blank half, and wherein the lid for a casket further comprises:

a second domed lid blank half comprising a second plurality trim edges around a periphery of the second lid blank half and having a first end, a second end, and a central region, the second domed lid blank half being domed in both a longitudinal direction and a transverse direction;

a second plurality of frame members attached to the second domed lid blank trim edges;

a second support laminate comprising a plurality of tabs, the second support laminate being fixed to the second domed lid blank half, wherein the tabs are secured to the second plurality of frame members; and a second header bridge attached to the second end of the second domed lid blank half;

wherein the first domed lid blank half and the second domed lid blank half are adapted to be attached to a casket shell with the second end of the first domed lid blank half facing the second end of the second domed lid blank half.

6. The lid for a casket according to claim 5, further comprising a first support bridge attached to the first domed lid blank half between the first end of the first domed lid blank half and the first header bridge, and a second support bridge attached to the second domed lid blank half between the first end of the second domed lid blank half and the second header bridge.

7. The lid for a casket according to claim 6, wherein the first support bridge comprises a first plurality of notches that extend under the first plurality of frame members, wherein a fastener protrudes from each notch on the first support bridge into a longitudinal frame member, of the plurality of frame members, of the first dome lid blank half, and the second support bridge comprises a second plurality of notches that extend under the second plurality of frame members, wherein a fastener protrudes from each notch on the second support bridge into a longitudinal frame member, of the second plurality of frame members, of the second dome lid blank half.

8. The lid for a casket according to claim 5, wherein the plurality of frame members comprises at least two first longitudinal frame members and a first transverse frame member and the second plurality of frame members comprises at least two second longitudinal frame members and a second transverse frame member.

9. The lid for a casket according to claim 1, wherein the domed lid blank further comprises a second pair of diagonal voids oriented at corners of the second end and extending inward toward the central region.

10. The lid for a casket according to claim 1, further comprising an outer surface comprising at least one of a wood veneer, paper veneer, or cloth.

11. A lid for a casket comprising:

a domed lid blank, having a first end, a second end, and a central region, comprising a pair of diagonal voids oriented at corners of the first end and extending inward toward the central region and a plurality of trim edges around a periphery of the domed lid blank;

wherein the domed lid blank comprises a first domed lid blank half comprising a header bridge attached to the second end of the first domed lid blank half;

a second domed lid blank half comprising a second plurality trim edges around a periphery of the second lid blank half and having a first end, a second end, and a central region, the second domed lid blank half being domed in both a longitudinal direction and a transverse direction;

a plurality of frame members attached to the trim edges of the domed lid blank;

a second plurality of frame members attached to the second domed lid blank trim edges;

a support laminate comprising a plurality of tabs, the support laminate being fixed to the domed lid blank, wherein the tabs are secured to the frame members;

a second support laminate comprising a plurality of tabs, the second support laminate being fixed to the second domed lid blank half, wherein the tabs are secured to the second plurality of frame members;

a second header bridge attached to the second end of the second domed lid blank half;

wherein the first domed lid blank half and the second domed lid blank half are adapted to be attached to a casket shell with the second end of the first domed lid blank half facing the second end of the second domed lid blank half; and a plurality of rim members attached to the periphery of the domed lid blank.

* * * * *